United States Patent [19]

Kerton

[11] Patent Number: 4,979,669

[45] Date of Patent: Dec. 25, 1990

[54] SELF-CLOSING BOX

[76] Inventor: Michael Kerton, P.O. Box 11021, Truckee, Calif. 95737

[21] Appl. No.: 376,791

[22] Filed: Jul. 7, 1989

[51] Int. Cl.[5] ..... B65D 5/24

[52] U.S. Cl. ..... 229/144; 229/145; 229/186

[58] Field of Search ..... 229/41 R, 41 B, 144, 229/145, 146, 186

[56] References Cited

U.S. PATENT DOCUMENTS

| | | | |
|---|---|---|---|
| 1,718,872 | 6/1929 | Ortiz | 229/144 |
| 2,565,288 | 8/1951 | Worfford . | |
| 2,613,025 | 10/1952 | Ringler . | |
| 2,634,045 | 4/1953 | Crinkley et al. | 229/144 |
| 2,692,722 | 10/1954 | Johnson | 229/41 B |
| 2,914,234 | 11/1959 | Hazelwood | 229/144 |
| 3,015,430 | 1/1962 | Bauer | 229/145 |
| 3,118,590 | 1/1964 | Kersh et al. . | |
| 3,191,175 | 7/1965 | Moreton . | |
| 3,840,172 | 10/1974 | Zimmermann . | |
| 4,136,816 | 1/1979 | Gardner . | |
| 4,331,238 | 5/1982 | Hanko et al. | 206/518 |
| 4,795,085 | 1/1989 | Wein | 229/41 R |

*Primary Examiner*—Gary E. Elkins

*Attorney, Agent, or Firm*—Townsend and Townsend

[57] ABSTRACT

A container including a one-piece folded body. The container includes a central portion divided into a bottom section, a rear section and a top section. First and second foldable hinges extend across the central section, substantially parallel to each other. The first and second hinges separate the bottom section from the rear section and the rear section from the top section, respectively. A side section adjoins the central section and is foldable along a first foldable crease perpendicular to the first and second hinges. The first foldable crease separates the side section from a bottom side section, rear section from a rear side section and the top section from a top side section. A crease is formed in the rear side section. A crease is also formed in the top side section. The creases in the rear and top side sections are substantially parallel to each other. Upon movement from the open position to the closed position, the container reaches a critical position at which a spring action biases the container to the closed position.

5 Claims, 3 Drawing Sheets

SELF-CLOSING BOX

BACKGROUND OF THE INVENTION

This invention relates to one-piece containers formed by a folded body.

One-piece folded containers are well-known. A lid portion is generally hingedly connected to the base portion to close the container. However, these containers generally do not remain closed without a separate mechanism for retaining the lids in the closed condition.

Numerous attempts have been made to construct a simple one-piece container which will remain closed during handling, storage and transport.

U S. Pat. No. 4,331,238 to Hanko et al. and U.S. Pat. No. 3,118,590 to Kersh et al. disclose one-piece foldable cartons having cutouts into which a tab fits to lock the container in the closed position.

U.S. Pat. No. 3,193,175 to Moreton discloses a carton having a closing mechanism incorporating gussets for retaining the lid in the closed position.

U.S. Pat. No. 4,136,816 to Gardner discloses a container designed to eliminate outside securing means. Gardner discloses an opening formed in the front wall of the container for receiving a closure flap integrally formed with the top wall.

SUMMARY OF THE INVENTION

The present invention is a one-piece folded body container which remains closed without the use of extrinsic closing fasteners.

The folded body includes a central section having first and second foldable creases horizontally dividing the central section into a bottom section, a rear section and a top section. Two foldable creases are parallel to each other and constitute a first and second hinge. Two sidewalls adjoin the central section along foldable creases disposed perpendicular to the first and second hinges. Each sidewall is divided into a bottom side section, a rear side section and a top side section.

The container has first, second, third and fourth points on each sidewall. The first and second points are disposed at the intersections of the first and second hinges and the crease forming the sidewall respectively. The third and fourth points are located at the end of the creases forming the first and second hinges at the top of the sidewalls, respectively.

A first closing mechanism is formed in the rear side section of each sidewall and includes (1) a foldable crease extending from the first point to the fourth point and (2) a foldable crease in the top side section extending from the second point in a direction parallel to the crease between the first and fourth points.

The fourth point contacts the exterior of the bottom side section, biasing the bottom side section toward the interior of the container, thereby urging the bottom side section inwardly. Upon closing, the closing mechanism reaches a critical position, creating a spring action such that the box "jumps" to the closed position.

DETAILED DESCRIPTION OF THE DRAWINGS

Figure 1:
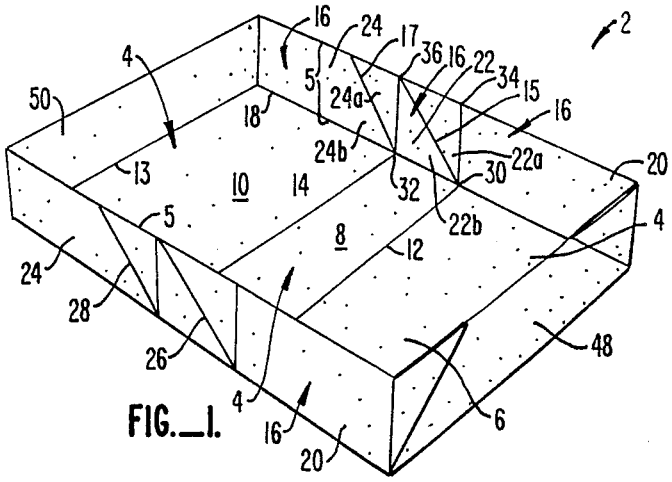
FIG. 1 is a perspective view of the open container of the present invention.

Referring now to the drawings, FIG. 1 illustrates container 2 in the open position constructed from blank 3 according to the present invention. Container 2 includes a central section 4 having side sections 16 adjoining central section 4. Side sections 16 are foldably connected to central section 4. A closing mechanism is formed by creases in portions 26 and 28 of side sections 16.

Figure 5:
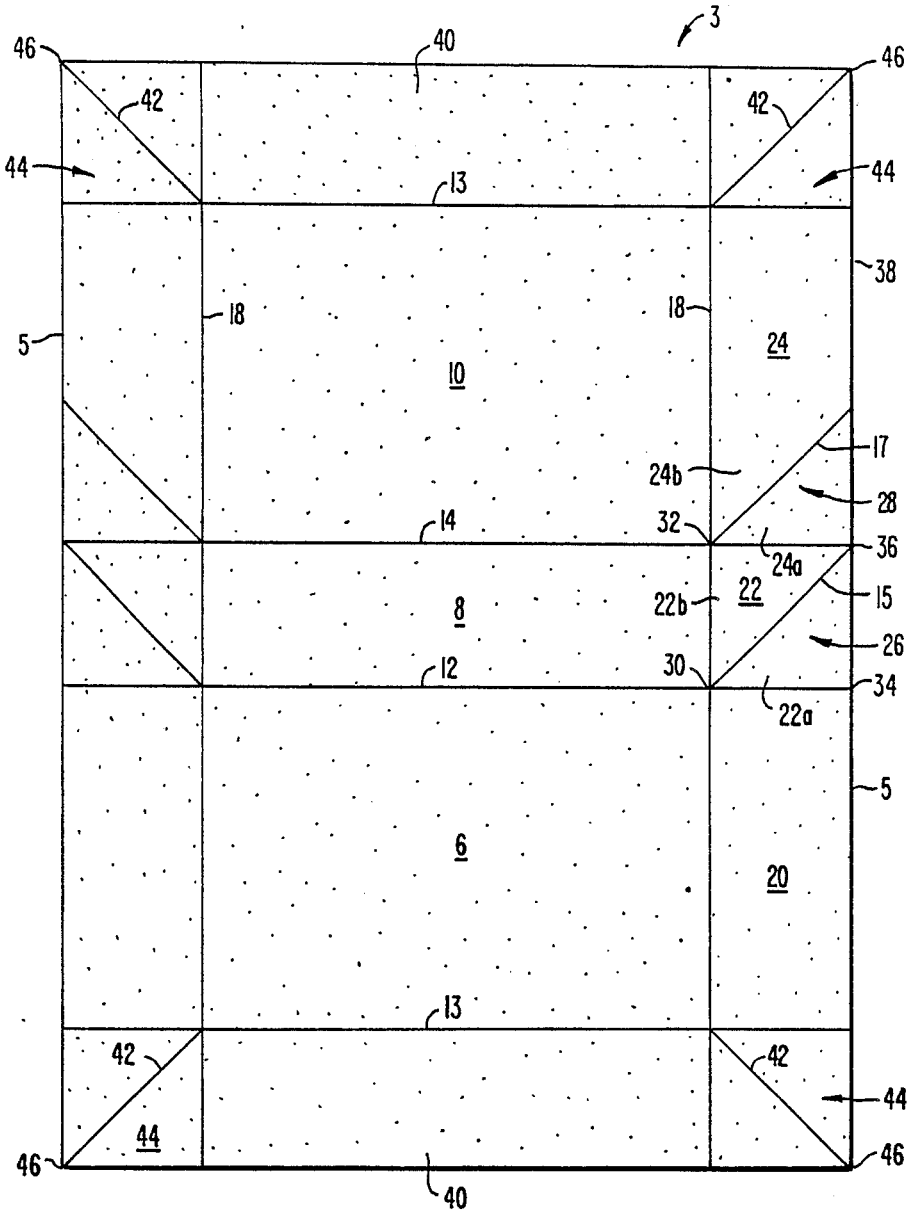
FIG. 5 is a top plan view of the blank from which the container of FIG. 1 is formed.

Turning to FIG. 5, blank 3 includes a first hinge 12 and a second hinge 14. First and second hinges 12, 14 are lined across the width of blank 3 in the midsection of the blank. Horizontal foldable creases 13 13 are lined proximal end regions 40 40 of blank 3, across the width of the blank. Third foldable creases 18, 18 are lined longitudinally in blank 3.

Central section 4 is formed between third foldable creases 18, 18. A side section 16 is formed between a third foldable crease 18 and outer perimeter 38 of blank 3, at each longitudinal edge 5. Third foldable creases 18, 18 separate central section 4 from side sections 16.

First and second hinges 12, 14 and horizontal foldable creases 13, 13 are parallel to each other and extend horizontally across blank 3. Progressing from a single end region 40 of blank 3 toward the opposite end region 40, the order of the foldable creases is as follows: a single horizontal foldable crease 13 first hinge 12, second hinge 14, and the remaining horizontal foldable crease 13. Third foldable creases 18, 18 are generally perpendicular to foldable creases 13. 13. However foldable creases 18, 18 are tapered slightly such that central section 4 is slightly wider at end region 40 adjacent second hinge 14 than at end region 40 adjacent first hinge 12, the purpose of which will be discussed below.

A radial foldable crease 42 extends from the intersection of each horizontal foldable crease 13 and third foldable crease 18 to form a corner region 44 at each of the four corners 46. The radial foldable crease 42 extends diagonally from the respective intersection of foldable crease 13 and third foldable crease 18 to each of the four corners 46. Radial foldable creases 42 are folded to form a bottom front end 48 and a top front end 50, as seen in FIGS. 1–4.

For ease of reference a single side section 16 will be hereinafter described. Although reference is made to only one longitudinal edge 5 of side section 16, it is to be understood that opposite longitudinal edge 5 of side section 16 is identical.

Central section 4 includes a bottom section 6, a rear section 8 and a top section 10. First hinge 12 separates bottom section 6 from rear section 8. Second hinge 14 separates rear section 8 from top section 10.

Side section 16 and central section 4 are foldable with respect to each other along third foldable crease 18 perpendicular to first hinge 12 and second hinge 14, as seen in FIG. 1. Third foldable crease 18 separates bottom side section 20 from bottom section 6; rear side section 22 from rear section 8: and top side section 24 from top section 10.

Rear side section 22 includes a first point 30, a second point 32, a third point 34 and a fourth point 36. First point 30 is disposed at the intersection of bottom section 6, rear section 8, bottom side section 20 and rear side section 22. Second point 32 is disposed at the intersection of rear section 8, top section 10, rear side section 22 and top side section 24. Third point 34 is disposed on edge 5 at the intersection of bottom side section 20 and rear side section 22. Fourth point 36 is disposed on edge 5 at the intersection of rear side section 22 and top side section 24.

The closing mechanism is formed in portions 26 and 28 of sidewall 16. Portion 26 has a first foldable crease 15 in rear side section 22 which extends from first point 30 to fourth point 36 at an angle of approximately 45° as seen most clearly in FIGS. 1 and 5. Portion 28 includes a second foldable crease 17 extending from second point 32 through top side section 24, parallel to first foldable crease 15.

In use, blank 3 is folded along radial foldable creases 42, horizontal foldable creases 13 and third foldable creases 18 to form the open configuration of container 2 as shown in FIG. 1. In the open configuration of first and second portions 26, 28, first and second creases 15, 17 are unfolded. Top section 10 and rear section 8 thereby form a part of the open container, as seen in FIG. 1.

Figure 2:
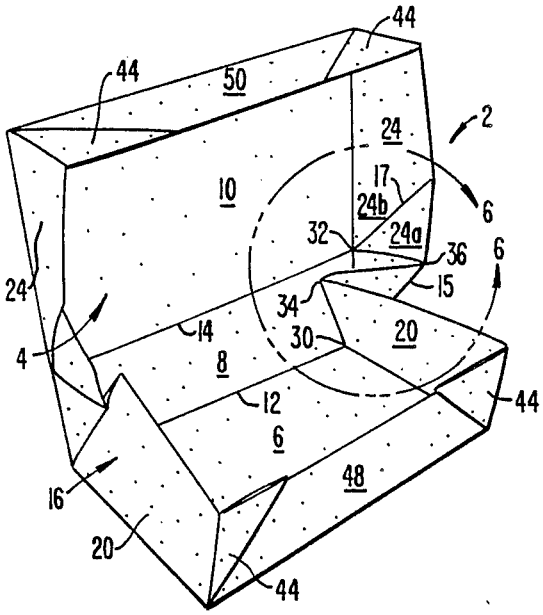
FIG. 2 is a perspective view of the container of FIG. 1 with the first hinge folded.
Figure 3:
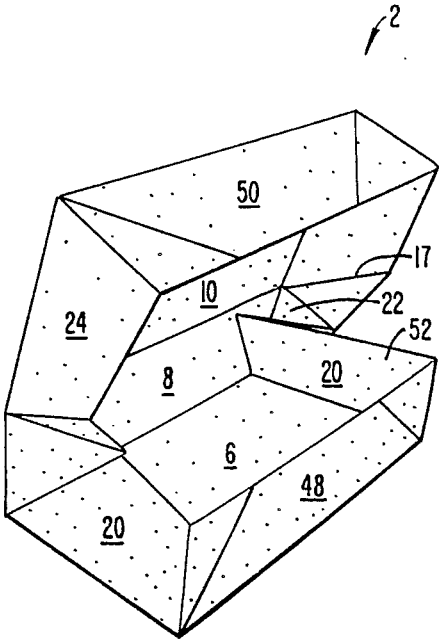
FIG. 3 is a perspective view of the container of FIG. 1 partially closed showing the closing mechanism at its critical position.
Figure 6:
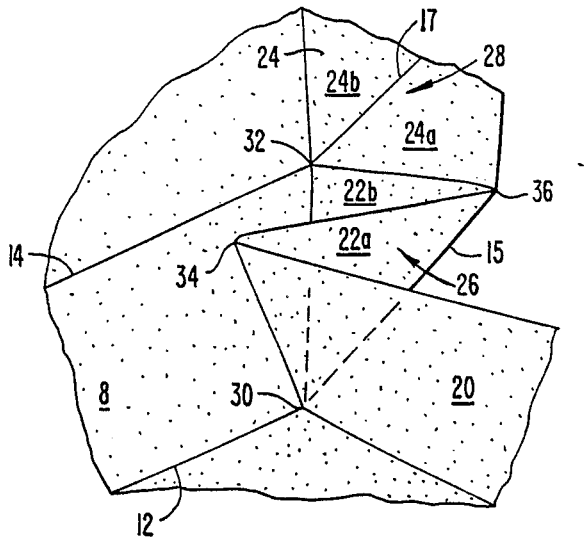
FIG. 6 is an enlarged section taken through FIG. 2 showing the closing mechanism in detail.

Top section 10 is moved to a vertical position to form a box-like configuration for container 2, as seen in FIG. 2. Referring now to FIGS. 2 and 6, first foldable crease 15 is folded so that the interiors of first sections **22*a*, 22*b* are in abutting relationship. Rear section 8 is thus positioned upright in perpendicular relation to bottom section 6. Top section 10 is generally parallel to rear section 8**.

Tapering of third foldable creases 18, 18 results in top section 10 having a slightly greater width than bottom section 6. This allows top section 10 to fit easily onto bottom section 6.

Folding of first foldable crease 15 brings second point 32 toward third point 34, positioning top 10 upright; perpendicular to bottom section 6 and aligned with rear section 8, as seen in FIG. 2. Fourth point 36 abuts outer edge 5 of upright side 20.

Turning now to FIG. 6, the closing mechanism including portions 26 and 28 is shown in more detail. Portion 26 is bent such that foldable crease 15 is folded from first point 30 to fourth point 36, as well as from first point 30 to third point 34. Portion 26 is positioned adjacent the exterior of bottom side section 20. Rear section 8 and top section 10 are aligned with each other perpendicular to bottom section 6, as seen in FIG. 2. Portion 28 is then employed by folding along foldable crease 17 from second point 32 through top side section 24, parallel to foldable crease 15. The interior sections **24*a*, 24*b* are then formed in abutting relationship. Second section 24*a* adjacent portion 26 moves inwardly, roughly perpendicular to rear section 8 to a position in which second section 24*a* is juxtaposed with portion 26 and parallel thereto. Fourth point 36 exerts a force on bottom side section 20, biasing top section 10** to the closed position.

Figure 4:
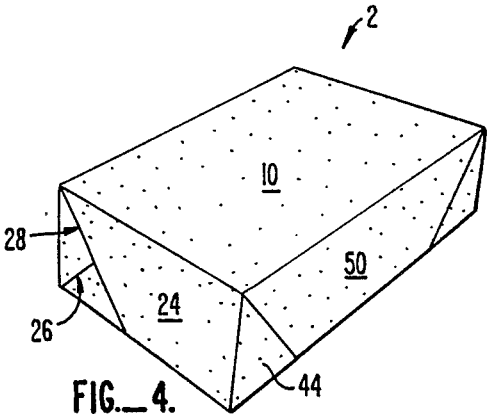
FIG. 4 is a perspective view of the container of FIG. 1 in the closed position.

To close container 2 and retain top section 10 in its completely closed position, as seen in FIG. 4, second foldable crease 17 is folded. At a critical position, a force is created at fourth point 36 on upright side 20 adjacent edge 5. The force applied results in a spring action such that the box "jumps" to the closed position. This spring action for closing container 2 is created by second portion 28, alone.

Blank 3 is constructed of any suitable material which is flexible while remaining adequately rigid. In the preferred embodiment, a thin corrugated material such as E-flute is employed, although any suitable material could be used. It will be noted that corner regions 46, foldable creases 15, 17 and the other foldable creases are creased rather than cut to form a container 2 which will not leak.

Figure 7:
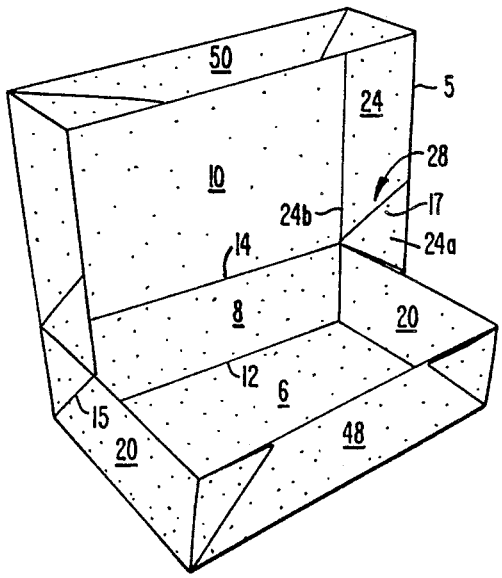
FIG. 7 is a perspective view of an alternate embodiment of the invention.

FIG. 7 illustrates an alternate embodiment of the invention employing only second portion 28 and not portion 26. In this embodiment, top section 10 remains halfway open, i.e., the top section remains upright with respect to bottom section 6. Top front end 50 is cut away for ease of displaying the contents of container 2, for examples, shoes.

Corner regions 44 are shown with radial foldable creases 42 and corner regions 44 folded over end regions 40; however, it should be noted that the corners may be formed in any manner. It is within the scope of the present invention to create the corners by folding radial foldable creases 42 inwardly, to fold corner regions 44 over side sections 16.

This invention has been described with reference to the preferred embodiment. Variations and modifications may be made without departing from the scope of the present invention, which is limited only by the following claims.

What is claimed is:

1. A container comprising a one-piece folded body adapted to assume a folded condition having an interior and an exterior, the container comprising:

a bottom section having a bottom side section;

a top section spaced from said bottom section and having a top side section adjacent said top section;

a rear section interconnecting said tip section and said bottom section, said rear section having a rear side section interconnecting said bottom side section and said top side section;

a closing mechanism including a first means for folding said rear side section; and a second means for folding said top side section;

a first point disposed at an intersection of said bottom section, said bottom side section, said rear section and said rear side section;

a second point disposed at an intersection of said rear section, said rear side section, said to section and said top side section;

said first means including a foldable crease extending from said first point outwardly away from said bottom section, said bottom side section and said rear section; and said second means including a foldable crease in said top side section extending from said second point substantially parallel to said foldable crease in said first means;

a third point disposed at an intersection of said bottom side section and said rear side section and spaced from said rear section, said first point and said third point interconnected by a foldable crease between said rear side section and said top side section;

a fourth point disposed at an intersection of said rear side section and said top side section and spaced from said rear section, said second point and said fourth point interconnected by a foldable crease between said rear side section and said top side section; and said crease of said foldable first means extending from said first point to said fourth point;

wherein in the folded condition, said fourth point biases said bottom side section toward the interior of the container.

2. A container comprising a one-piece folded body adapted to assume a folded condition having an interior and an exterior, the container comprising:

a bottom section having a bottom side section;

a top section spaced from said bottom section and having a top side section adjacent said top section;

a rear section interconnecting said top section and said bottom section, said rear section having a rear side section interconnecting said bottom side section and said top side section;

a closing mechanism including a first means for folding said rear side section; and a second means for folding said top side section;

a first point disposed at an intersection of said bottom section, said bottom side section, said rear section and said rear side section;

a second point disposed at an intersection of said rear section, said rear side section, said top section and said top side section;

said first means including a foldable crease extending from said first point outwardly away from said bottom section, said bottom side section and said rear section; and said second means including a foldable crease in said top side section extending from said second point substantially parallel to said foldable crease in said first means;

a third point disposed at an intersection of said bottom side section and said rear side section and spaced from said rear section, said first point and said third point interconnected by a foldable crease between said rear side section and said top side section;

a fourth point disposed at an intersection of said rear side section and said top side section and spaced from said rear section, said second point and said fourth point interconnected by a foldable crease between said rear side section and said top side section; and said crease of said foldable first means extending from said first point to said fourth point;

wherein in the folded condition, said second and third points intersect at a location spaced from said bottom section and wherein said fourth point biases said bottom side section toward the interior of the container.

3. A container comprising a one-piece folded body adapted to assume a folded condition having an interior and an exterior, the container comprising:

a bottom section having a bottom side section;

a top section spaced from said bottom section and having a top side section adjacent said top section;

a rear section interconnecting said top section and said bottom section, said rear section having a rear side section interconnecting said bottom side section and said top side section;

a closing mechanism including a first means for folding said rear side section; and a second means for folding said top side section;

a first point disposed at an intersection of said bottom section, said bottom side section, said rear section and said rear side section;

a second point disposed at an intersection of said rear section, said rear side section, said top section and said top side section;

said first means including a foldable crease extending from said first point outwardly away from said bottom section, said bottom side section and said rear section; and said second means including a foldable crease in said top side section extending from said second point substantially parallel to said foldable crease in said first means;

a third point disposed at an intersection of said bottom side section and said rear side section and spaced from said rear section, said first point and said third point interconnected by a foldable crease between said rear side section and said top side section;

a fourth point disposed at an intersection of said rear side section and said top side section and spaced from said rear section, said second point and said fourth point interconnected by a foldable crease between said rear side section and said top side section; and said crease of said foldable first means extending from said first point to said fourth point;

wherein said fourth point contacts the exterior of said bottom side section, thereby biasing said bottom side section toward the interior of the container.

4. A container comprising a one-piece folded body adapted to assume a folded condition having an interior and an exterior, the container comprising:

a bottom section having a bottom side section;

a top section spaced from said bottom section and having a top side section adjacent said top section;

a rear section interconnecting said top section and said bottom section, said rear section having a rear side section interconnecting said bottom side section and said top side section;

a first point disposed at an intersection of said bottom section, said bottom side section, said rear section, said rear side section;

a second point disposed at an intersection of said rear section, said rear side section, said top section and said top side section;

a third point disposed at an intersection of said bottom side section and said rear side section and spaced from said rear section, said first point and said third point interconnected by a foldable crease between said bottom side section and said rear side section;

a fourth point disposed at an intersection of said rear side section and said top side section and spaced from said rear section, said second point and said fourth point interconnected by a second foldable crease between said rear side section and said top side section;

a third foldable crease extending from said first point to said fourth point;

a fourth foldable crease extending from said second point in a direction substantially parallel to said first hinge;

wherein in the folded condition, said fourth point biases said bottom side section toward the interior of the container.

5. A container comprising a one-piece folded body adapted to assume a folded condition having an interior and an exterior, the container comprising:

a bottom section having a bottom side section;

a top section spaced from said bottom section and having a top side section adjacent said top section;

a rear section interconnecting said top section and said bottom section, said rear section having a rear side section interconnecting said bottom side section and said top side section;

a first point disposed at an intersection of said bottom section, said bottom side section, said rear section, said rear side section;

a second point disposed at an intersection of said rear section, said rear side section, said top section and said top side section;

a third point disposed at an intersection of said bottom side section and said rear section and spaced from said rear section, said first point and said third point interconnected by a foldable crease between said bottom side section and said rear side section;

a fourth point disposed at an intersection of said rear side section and said top section and spaced from said rear section, said second point and said fourth point interconnected by a second foldable crease between said rear side section and said top side section;

a third foldable crease extending from said first point to said fourth point;

a fourth foldable crease extending from said second point in a direction substantially parallel to said first hinge;

wherein said fourth point contacts the exterior of said bottom side section, thereby biasing said bottom side section toward the interior of the container.

* * * * *